US006876341B2

(12) United States Patent
Ide et al.

(10) Patent No.: US 6,876,341 B2
(45) Date of Patent: Apr. 5, 2005

(54) DRIVING APPARATUS OF DISPLAY PANEL

(75) Inventors: Shigeo Ide, Yamanashi-ken (JP); Hideto Nakamura, Yamanashi-ken (JP); Kazuaki Sakata, Yamanashi-ken (JP); Yoshichika Sato, Yamanashi-ken (JP); Tsutomu Tokunaga, Yamanashi-ken (JP); Hideki Tanaka, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/691,976

(22) Filed: Oct. 24, 2003

(65) Prior Publication Data

US 2004/0164929 A1 Aug. 26, 2004

(30) Foreign Application Priority Data

Oct. 24, 2002 (JP) ..... 2002-310140
Mar. 20, 2003 (JP) ..... 2003-077872
Jul. 15, 2003 (JP) ..... 2003-197005

(51) Int. Cl.[7] ..... G09G 3/28
(52) U.S. Cl. ..... 345/60; 345/211; 315/169.2
(58) Field of Search ..... 315/169.1–169.4; 345/60–65, 77, 92, 211, 52

(56) References Cited

U.S. PATENT DOCUMENTS 6,072,448 A * 6/2000 Kojima et al. ..... 345/63
6,686,912 B1 * 2/2004 Kishi et al. ..... 345/211
6,707,436 B2 * 3/2004 Setoguchi et al. ..... 345/60
6,717,557 B2 * 4/2004 Ishizuka ..... 345/60

FOREIGN PATENT DOCUMENTS

JP 2000-155557 A 6/2000

* cited by examiner

*Primary Examiner*—Wilson Lee

(57) ABSTRACT

A driving apparatus for a display panel capable of reducing a circuit scale while suppressing the drop of a contrast includes a scan driver having a first power source for generating a first voltage, generating a scan pulse for bringing the capacitive light emission device to either an ON state or an OFF state based on the first voltage, and applying the scan pulse to the row electrode, a sustain driver having a second power source for generating a second voltage, generating a sustain pulse for allowing the capacitive light emission device set to the ON state to emit light based on the second voltage, and applying the scan pulse to the row electrode, and a reset driver generating a reset pulse for initializing the capacitive light emission device based on the sum of the first voltage and the second voltage, and applying the reset pulse to the row electrode.

13 Claims, 11 Drawing Sheets

DRIVING APPARATUS OF DISPLAY PANEL

BACKGROUND OF THE INVENTION

1. Field of the Invention

This invention relates to a driving apparatus of a display panel having capacitive light emitting devices arranged in matrix form.

2. Description of the Related Art

A display apparatus having a plasma display panel mounted thereto is now commercially available as the display panel described above (for example, Japanese Patent Kokai No. 2000-155557 (Patent Reference 1)).

FIG. 1 schematically shows the construction of such a display apparatus.

Referring to FIG. 1, row electrodes $Y_1$ to $Y_n$ and row electrodes $X_1$ to $X_n$ are shown to be formed in a PDP1 as the plasma display panel, whereby each pair of X and Y constitute a row electrode pair corresponding to each row (first to nth rows) of one screen. Column electrodes $D_1$ to $D_m$ respectively constituting column electrodes corresponding to columns (first to nth columns) of one screen are further formed in such a way as to intersect these row electrode pairs and to sandwich a dielectric layer and discharge spaces, not shown in the drawing. In this case, each discharge cell as a capacitive light emitting device is formed at each point of intersection between each row electrode pair and each column electrode. An address driver 2 converts pixel data of each pixel based on an image signal to a pixel data pulse having a voltage value corresponding to a logic level of the data and applies this pixel data pulse to the column electrodes $D_1$ to $D_m$ for each row. An X row electrode driver 3 generates a reset pulse for initializing a residual wall charge amount of each discharge cell and a sustain discharge pulse for keeping a discharge light emission state of the discharge cell set to an ON mode which will be explained later, and applies these pulses to the row electrodes $X_1$ to $X_n$. A Y rowelectrode driver 4 generates a reset pulse for initializing the residual wall charge amount of each discharge cell and a sustain discharge pulse for keeping the discharge light emission state of the discharge cell in the same way as the X row electrode driver 3, and applies these pulses to the row electrodes $Y_1$ to $Y_n$. The Y row electrode driver 4 further generates a priming pulse for re-forming charge particles inside the discharge cell and a scan pulse SP for forming a charge amount corresponding to the pixel data pulse for each discharge cell and setting each discharge cell to either the ON mode or the OFF mode, and applies these pulses to the row electrodes $Y_1$ to $Y_n$.

FIG. 2 shows an internal construction of the X row electrode driver 3 and the Y row electrode driver 4. Incidentally, an electrode $X_j$ in FIG. 2 represents an electrode of a jth row among the electrodes $X_1$ to $X_n$, and an electrode $Y_j$ represents an electrode of the jth row among the electrodes $Y_1$ to $Y_n$.

The X row electrode driver 3 has two power sources B101 and B102. The power source B101 outputs a voltage Vs1 (for example, 170 V) and the power source B102 outputs a voltage Vr1 (for example, 190V). A positive terminal of the power source B101 is connected to a connection line 111 of the electrode $X_j$ through a switching device S103 and its negative terminal is grounded. A switching device S104 is interposed between the connection line 111 and the ground. A series circuit including a switching device S101, a diode D101 and a coil L101 and a series circuit including a coil L102, a diode D102 and a switching device S102 are connected to the ground through a capacitor C101 in common. The diode D101 has its anode on the side of the capacitor C101 and the diode D102 has its cathode on the side of the capacitor C101. A positive terminal of the power source B102 is connected to the connection line 111 through a switching device S108 and a resistor R101 and its negative terminal is connected to the ground. The Y row electrode driver 4 has four power sources B103 to B106. The power source B103 outputs the voltage Vs1 (for example, 170 V). The power source B104 outputs the voltage Vr1 (for example 190 V). The power source B105 outputs a voltage $V_{off}$ (for example, 140 V) and the power source B106 outputs a voltage $V_h$ (for example, 160 V, $V_h > V_{off}$). A positive terminal of the power source B103 is connected to a connection line 112 to a switching device S115 through a switching device S113 and its negative terminal is grounded. A switching device S114 is interposed between the connection line 112 and the ground. A series circuit including a switching device S111, a diode D103 and a coil L104 and a series circuit including a coil L104, a diode D104 and a switching device S112 are connected to the ground through a capacitor C102 in common. The diode D103 has its anode on the side of the capacitor C102 and the diode D104 has its cathode on the side of the capacitor C102. The connection line 112 is connected to a connection line 113 of a positive terminal of the power source B106 through a switching device S115. A positive terminal of the power source B104 is connected to the ground and its negative terminal is connected to the connection line 113 through a switching device S116 and a resistor R102. A positive terminal of the power source B105 is connected to the connection line 113 through a switching device S117 and its negative terminal is grounded. The connection line 113 is connected to a connection line 114 to the electrode $Y_j$ through a switching device S121. A negative terminal of the power source B106 is connected to the connection line 114 through a switching device S122. A diode D105 is connected between the connection lines 113 and 114 and a series circuit of a switching device S123 and a diode D106 is connected to the diode D105. The diode D105 has its anode on the side of the connection line 114 and the diode D106 has its cathode on the side of the connection line 114.

Here, a control circuit, not shown in the drawing, controls ON/OFF switching of the switching devices S101 to S104, S111 to S117 and S121 to S123.

Incidentally, the power source B103, the switching devices S111 to S115, the coils L103 and L104, the diodes D103 and D104 and the capacitor C102 inside the Y row electrode driver 4 constitute a sustain driver part. The power source B104, the resistor R102 and the switching device S116 constitute a reset driver part. The remaining power sources B105 and B106, switching devices S113, S117, S121 and S122 and diodes D105 and D106 constitute a scan driver part.

Next, the operation in the construction described above will be explained with reference to a timing chart of FIG. 3.

As shown in FIG. 3, driving of the PDP 1 is conducted dividedly in a reset period, an address period and a sustain period.

First of all, in the reset period, the switching device S123 of the Y row electrode driver 4 turns ON. The switching device S123 remains ON in the reset period and the sustain period. At the same time, the switching device S108 of the X row electrode driver 3 turns ON and the switching device S116 of the Y row electrode driver 4 turns ON. Other switching devices remain OFF. When the switching device S108 is turned ON, a current flows from the positive terminal of the power source B102 to the electrode $X_j$ through the switching device S108 and the resistor R101. When the switching device S116 is turned ON, a current flows from the electrode $Y_j$ into the negative terminal of the power source B104 through the diode D106, the resistor R102 and the switching device S116. In this case, the potential on the electrode $X_j$ gradually rises due to the time constant of the load capacitance Co and the resistor R101 of the PDP 1, generating the reset pulse $RP_x$ as shown in FIG. 3. On the other hand, the potential of the electrode $Y_j$ gradually lowers due to the time constant of the load capacitance C0 and the resistor R102, generating the reset pulse $RP_y$ as shown in FIG. 3. The reset pulse $RP_x$ is simultaneously applied to all electrodes $X_1$ to $X_n$ and the reset pulse $RP_y$ is simultaneously applied to all electrodes $Y_1$ to $Y_n$. As these reset pulses $RP_x$ and $RP_y$ are simultaneously applied, reset discharge is induced inside all discharge cells of the PDP 1. After the finish of this discharge, wall charge of a predetermined amount is uniformly generated in the dielectric layer of all discharge cells. Such reset discharge initializes all discharge cells to the ON mode. After the levels of the reset pulses $RP_x$ and $RP_y$ get into saturation, the switching devices S108 and S116 turn OFF before the termination of the reset period. At this point, the switching devices S104, S114 and S115 are turned ON and both electrodes $X_j$ and $Y_j$ are grounded. In consequence, the reset pulses $RP_x$ and $RP_y$ disappear.

Next, in the address period, the switching devices S114 and S115 turn OFF, the switching device S123 turns OFF, the switching device S117 turns ON and at the same time, the switching device S122 turns ON. As the switching device S117 is turned ON, the power source B105 and the power source B106 are connected in series, and a negative potential representing the difference between the voltages $V_h$ and $V_{off}$ appears at the negative terminal of the power source B106 and is applied to the electrode $Y_j$. In this address period, the address driver 2 converts the pixel data for each pixel based on the image signal to pixel data pulses $DP_1$ to $DP_n$ having a voltage value corresponding to the logic level of the image data and serially applies these data pulses to the column electrodes $D_1$ to $D_m$. As shown in FIG. 3, the image data pulses $DP_j$ and $DP_{j+1}$ are applied to the electrodes $Y_j$ and $Y_{j+1}$. In the mean time, the Y row electrode driver 4 serially applies the priming pulse PP of the positive voltage to the row electrodes $Y_1$ to $Y_n$, and also applies serially the scan pulse SP of the negative voltage to the row electrode $Y_1$ to $Y_n$ in synchronism with each timing of the pixel data pulse group $DP_1$ to $DP^n$ immediately after the application of each priming pulse PP. Explanation will be given on the electrode $Y_j$. When generating the priming pulse PP, the switching device S121 turns ON and the switching device S122 turns OFF. The switching device S117 remains ON. In consequence, the potential $V_{off}$ of the positive terminal of the power source B105 is applied as the priming pulse PP to the electrode $Y_j$ through the switching device S117 and then through the switching device S121. After the application of this priming pulse PP, the switching device S121 turns OFF while the switching device S122 turns ON in synchronism with the application of the pixel data pulse $DP_j$ from the address driver 2. In consequence, a negative potential representing the difference between the voltage $V_h$ of the negative terminal of the power source B106 and the $V_{off}$ is applied as the scan pulse SP to the electrode $Y_j$. In synchronism with the stop of the application of the pixel data pulse $DP_j$ from the address driver 2, the switching device S121 turns ON and the switching device S122 turns OFF. The potential $V_{off}$ of the positive terminal of the power source B105 is applied to the electrode $Y_j$ through the switching device S117 and then through the switching device S121. As to the electrode $Y_{j+1}$, too, the priming pulse PP is thereafter applied in the same way as the electrode $Y_j$ as shown in FIG. 3 and the scan pulse SP is applied in synchronism with the application of the pixel data pulse $DP_{j+1}$ from the address driver 2. Discharge develops in the discharge cells to which the pixel data pulse of the positive voltage is further applied simultaneously among the discharge cells belonging to the row electrodes to which the scan pulse SP is applied, and the wall charge is mostly lost. On the other hand, discharge does not develop in the discharge cells to which the scan pulse SP is applied but the pixel data pulse of the positive voltage is not applied, and the wall charge remains as such. In this case, the discharge cells the wall charge of which disappears are set to the OFF mode and the discharge cells the wall charge of which remains are set to the ON mode. When the address period shifts to the sustain period, the switching devices S117 and S121 turn OFF and the switching devices S114 and S115 turn ON instead. The ON state of the switching device S104 is continued.

In the sustain period, the switching device S104 of the X row electrode driver 3 is turned ON and consequently, the potential of the electrode $X_j$ reaches the ground potential that is substantially 0 V. Next, when the switching device S104 is turned OFF and the switching device S101 is turned ON, a current resulting from the charge stored in the capacitor C1 flows into the electrode $X_j$ through the coil L101, the diode D101 and the switching device S101 and charges the load capacitance C0 of the PDP 1. In this process, the potential of the electrode $X_j$ gradually moves up due to the time constant of the coil L101 and the load capacitance C0 as shown in FIG. 3. Next, the switching device S101 turns OFF and the switching device S103 turns ON. In consequence, the potential $V_{s1}$ of the positive terminal of the power source B101 is applied to the electrode $X_j$. The switching device S103 is thereafter turned OFF, the switching device S102 is turned ON and a current resulting from the charge stored in the load capacitance C0 flows from the electrode $X_j$ into the capacitor C101 through the coil L102, the diode D102 and then through the switching device S102. In this case, the potential of the electrode $X_j$ gradually lowers due to the time constant of the coil L102 and the capacitor C101 as shown in FIG. 3. When the potential of the electrode $X_j$ reaches substantially 0 V, the switching device S102 turns OFF and the switching device S104 turns ON. Due to this operation, the X row electrode driver 3 applies the sustain discharge pulse $IP_x$ of the positive voltage such as shown in FIG. 3 to the electrode $X_j$. At the time of turn-ON of the switching device S104 at which the sustain discharge pulse $IP_x$ disappears, the switching device S111 of the Y row electrode driver 4 turns ON while the switching device S114 turns OFF. When the switching device S114 is ON, the potential of the electrode $Y_j$ is at the ground potential that is substantially 0 V. When the switching device S114 is turned OFF and the switching device S111 is turned ON, however, a current resulting from the charge stored in the capacitor C102 flows into the electrode $Y_j$ through the coil L103, the diode D103, the switching devices S111, S115 and S113 and the diode D106, and charges the load capacitance C0 of the PDP1. In this case, the potential of the electrode $Y_j$ gradually moves up due to the time constant of the coil L103 and the load capacitance C0 as shown in FIG. 3. Next, the switching device S111 turns OFF and the switching device S113 turns ON. Consequently, the potential $V_{s1}$ of the positive terminal of the power source B103 is applied to the electrode $Y_j$. Thereafter, the switching device S113 is turned OFF, the switching device S112 is turned ON and a current resulting from the charge stored in the load capacitor C0 flows from the electrode $Y_j$ to the capacitor C102 through diode D105, the switching device S115, the coil L104, the diode D104 and then the switching device S112. In this case, the potential of the electrode $Y_j$ gradually lowers due to the time constant of the coil L104 and the capacitor C102 as shown in FIG. 3. When the potential of the electrode $Y_j$ reaches substantially 0 V, the switching device S112 turns OFF and the switching device S114 turns ON. By this operation, the Y row electrode driver 4 applies the sustain discharge pulse $IP_y$ of the positive voltage such as shown in FIG. 3 to the electrode $Y_j$.

As described above, the sustain discharge pulse $IP_x$ and the sustain discharge pulse $IP_y$ are alternately applied to the electrodes $X_1$ to $X_n$ and to the electrodes $Y_1$ to $Y_n$ in the sustain period. Therefore, only the discharge cells the wall charge of which remains, that is, only the discharge cells set to the ON mode, repeat discharge light emission and keep the light emission state.

Incidentally, reset discharge induced so as to initialize altogether the wall charge amounts inside all discharge cells during the reset period must be relatively strong discharge. Therefore, the pulse voltage (−Vr1) of the reset pulse $RP_y$ is set to a voltage level higher than the pulse voltage of the sustain discharge pulse $IP_y$. For this purpose, the power source B104 (voltage Vr1) for generating the voltage higher than the voltage Vs1 of the power source B103 for generating the sustain discharge pulse IPy is disposed, and results in the increase of the circuit scale. In addition, the voltage values of the power sources B103 and B104 are mutually different and the switching devices S113, S115 and S116 interposed between these power sources B103 and B104 are the semiconductor switches, so that the possibility exists that the reverse current flows between the power sources B103 and B104. Furthermore, light emission with reset discharge does not at all participate in the display image, the lowering of contrast occurs.

The invention is completed to solve the problems described above and aims at providing a driving apparatus of a display panel that can reduce the scale of the circuit.

It is another object of the invention to provide a driving apparatus of a display panel that can reduce a circuit scale while suppressing the drop of contrast.

SUMMARY OF THE INVENTION

According to a first aspect of the invention, there is provided a driving apparatus for driving a display panel having a plurality of row electrodes, a plurality of column electrodes so arranged as to intersect the row electrodes and a capacitive light emission device formed at each intersection of the row electrode and the column electrode, comprising a scan driver having a first power source for generating a first voltage, generating a scan pulse for bringing the capacitive light emission device to either one of an ON state and an OFF state based on the first voltage, and applying the scan pulse to said row electrode, a sustain driver having a second power source for generating a second voltage, generating a sustain discharge pulse for allowing the capacitive light emission device set to the ON state to emit light based on the second voltage, and applying the scan pulse to the row electrode, and a reset driver generating a reset pulse for initializing the state of the capacitive light emission device based on the sum of the first voltage generated by the first power source and the second voltage generated by the second power source, and applying the reset pulse to the row electrode.

According to another aspect of the invention, there is provided a driving apparatus for driving a display panel having a plurality of row electrodes, a plurality of column electrodes so arranged as to intersect the row electrodes and a capacitive light emission device formed at each intersection of the row electrode and the column electrode, comprising a scan driver having a first power source for generating a first voltage, generating a scan pulse for bringing the capacitive light emission device to either one of an ON state and an OFF state based on the first voltage, and applying the scan pulse to the row electrode, a sustain driver having a second power source for generating a second voltage, generating a sustain discharge pulse for allowing the capacitive light emission device set to the ON state to emit light based on the second voltage, and applying the scan discharge pulse to the row electrode, and a reset driver generating a reset pulse for initializing the state of the capacitive light emission device based on the sum of the first voltage generated by the first power source and the second voltage generated by the second power source, and applying the reset pulse to the row electrode, wherein the reset driver generates a pulse signal having a waveform exhibiting a sharp level shift at a front edge thereof and a gentle level shift at a portion succeeding the front edge.

DETAILED DESCRIPTION OF THE INVENTION

Embodiments of the invention will be hereinafter explained in detail with reference to the accompanying drawings.

Figure 1:
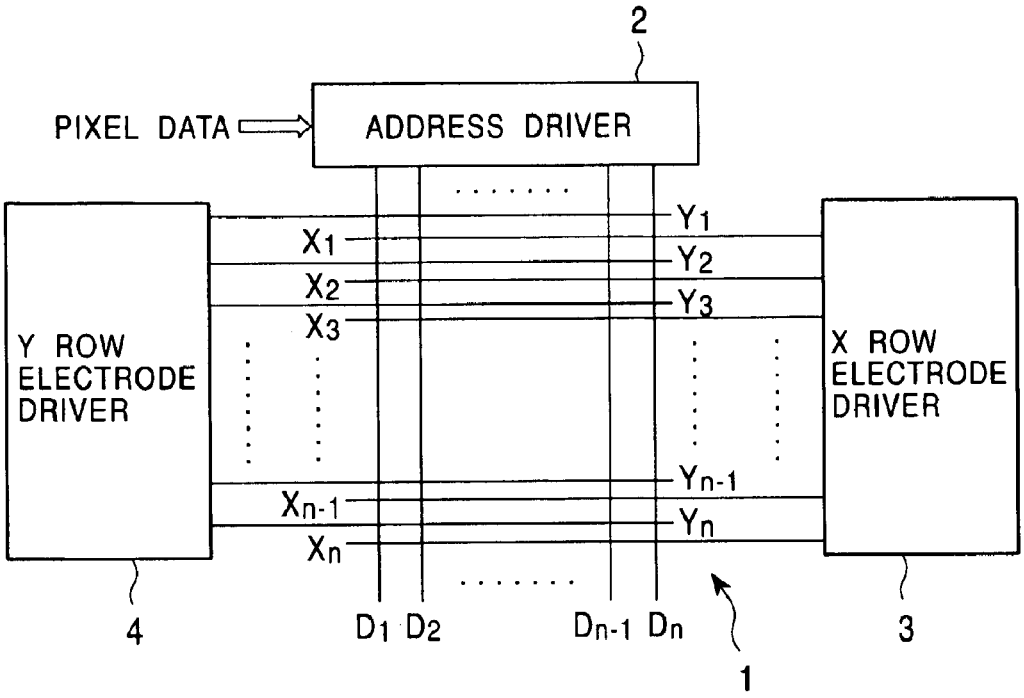
FIG. 1 is a view schematically showing the construction of a plasma display apparatus.
Figure 2:
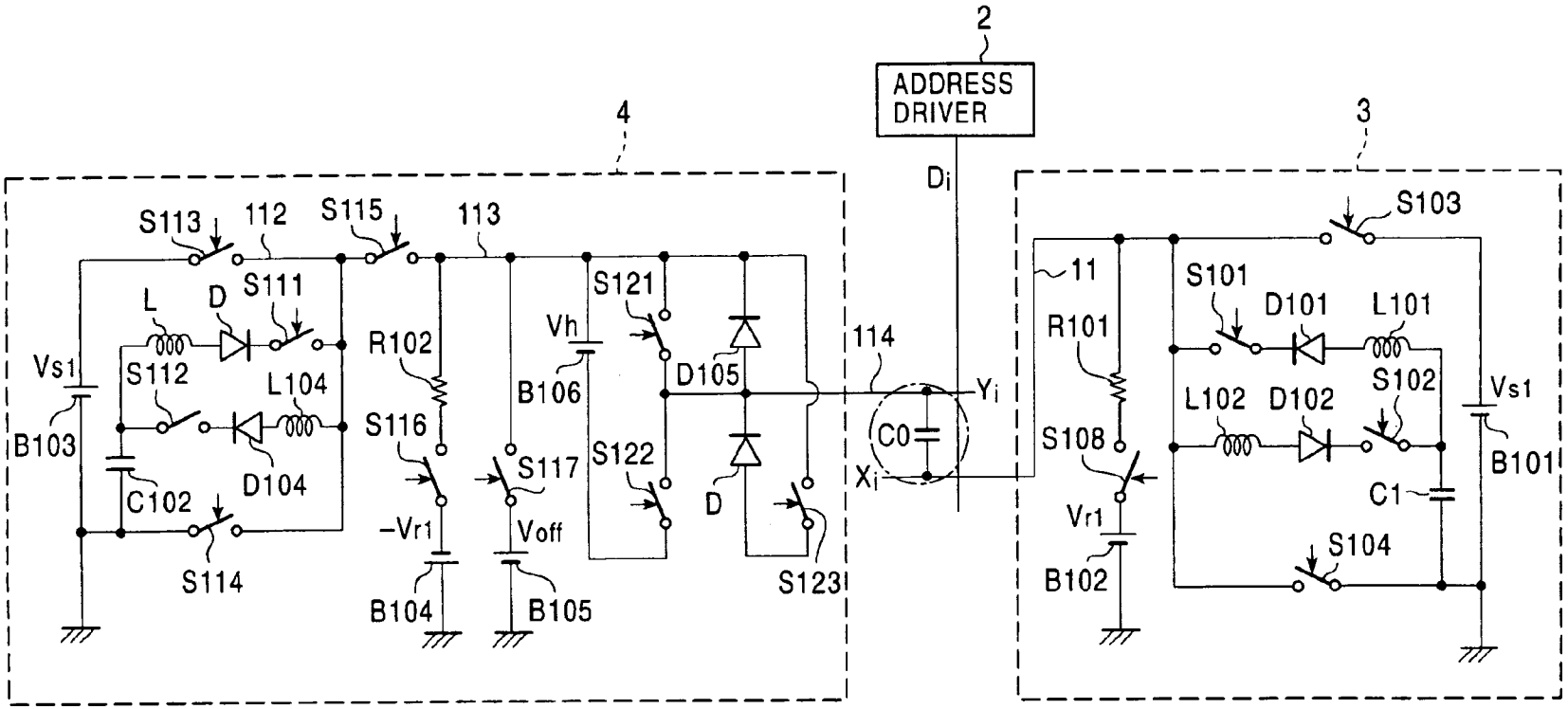
FIG. 2 is a view showing an internal construction of an X row electrode driver 3 and a Y row electrode driver 4 of the plasma display apparatus shown in FIG. 1.
Figure 3:
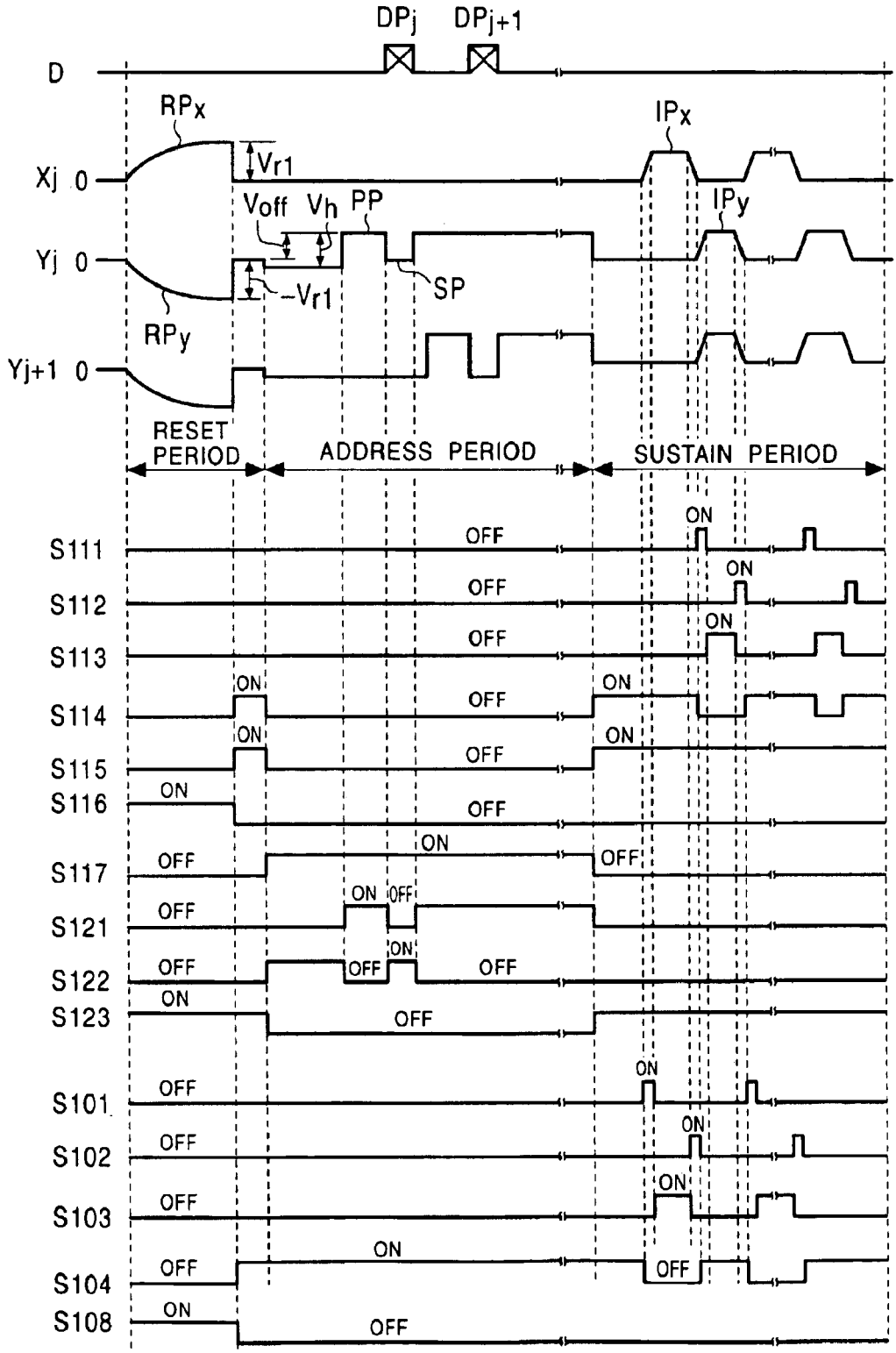
FIG. 3 is a time chart showing operations of the X row electrode driver 3 and the Y row electrode driver 4.
Figure 4:
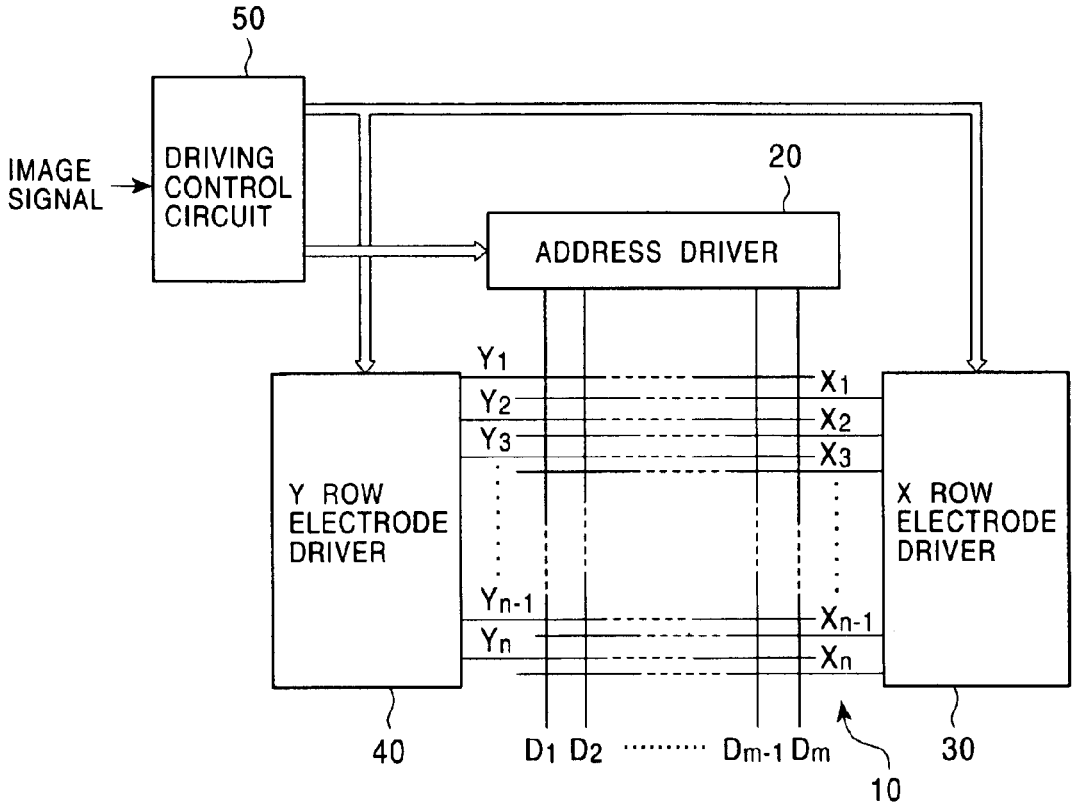
FIG. 4 is a view schematically showing the construction of a plasma display apparatus according to the invention.

FIG. 4 is a view schematically showing the construction of a plasma display apparatus having mounted thereto a PDP as a display panel.

Referring to FIG. 4, the PDP 10 as a plasma display panel includes row electrodes $Y_1$ to $Y_n$ and $X_1$ to $X_n$ that constitute row electrode pairs each corresponding to each display line (first to nth display lines) of one screen. The PDP 10 further includes column electrodes $D_1$ to $D_m$ that intersect at right angles the row electrode pairs and correspond to each column (first to mth columns) of one screen while sandwiching a dielectric layer and a discharge space not shown in the drawing. Incidentally, a discharge cell as a capacitive light-emitting device is formed at the point of intersection between one row electrode pair (X, Y) and one column electrode D.

Figure 5:
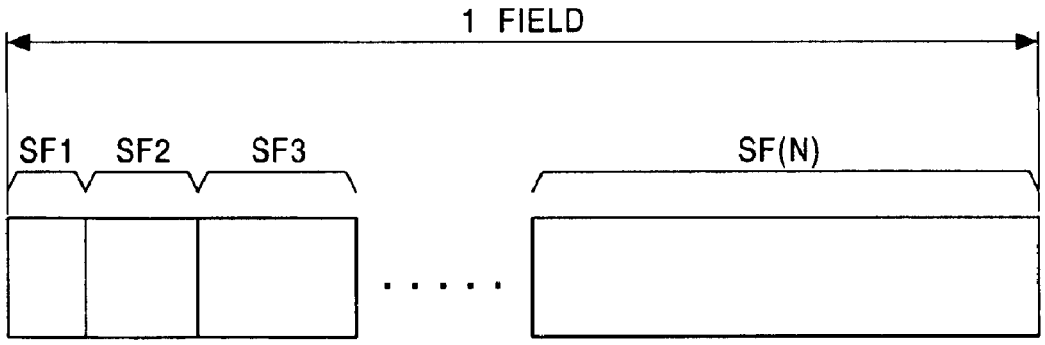
FIG. 5 is a view showing a schematic driving format based on a sub-field method.

A driving control circuit 50 converts an input image signal to pixel data for each pixel and divides this pixel data to each bit digit to acquire a pixel data bit. The driving control circuit 50 supplies the pixel data bits for each display line (m) to the address driver 20 at the same bit digit. Further, the driving control circuit 50 supplies various kinds of switching signals SW (to be later described) to each of the X row electrode driver 30 and the Y row electrode driver 40 in order to drive the PDP10 in accordance with the light emission drive format based on the sub-field method as shown in FIG. 5. Incidentally, the sub-field method divides each field in the image signal to N sub-fields SF1 to SF(N) shown in FIG. 5 and drives each pixel for each sub-field for light emission to express intermediate brightness.

Figure 6:
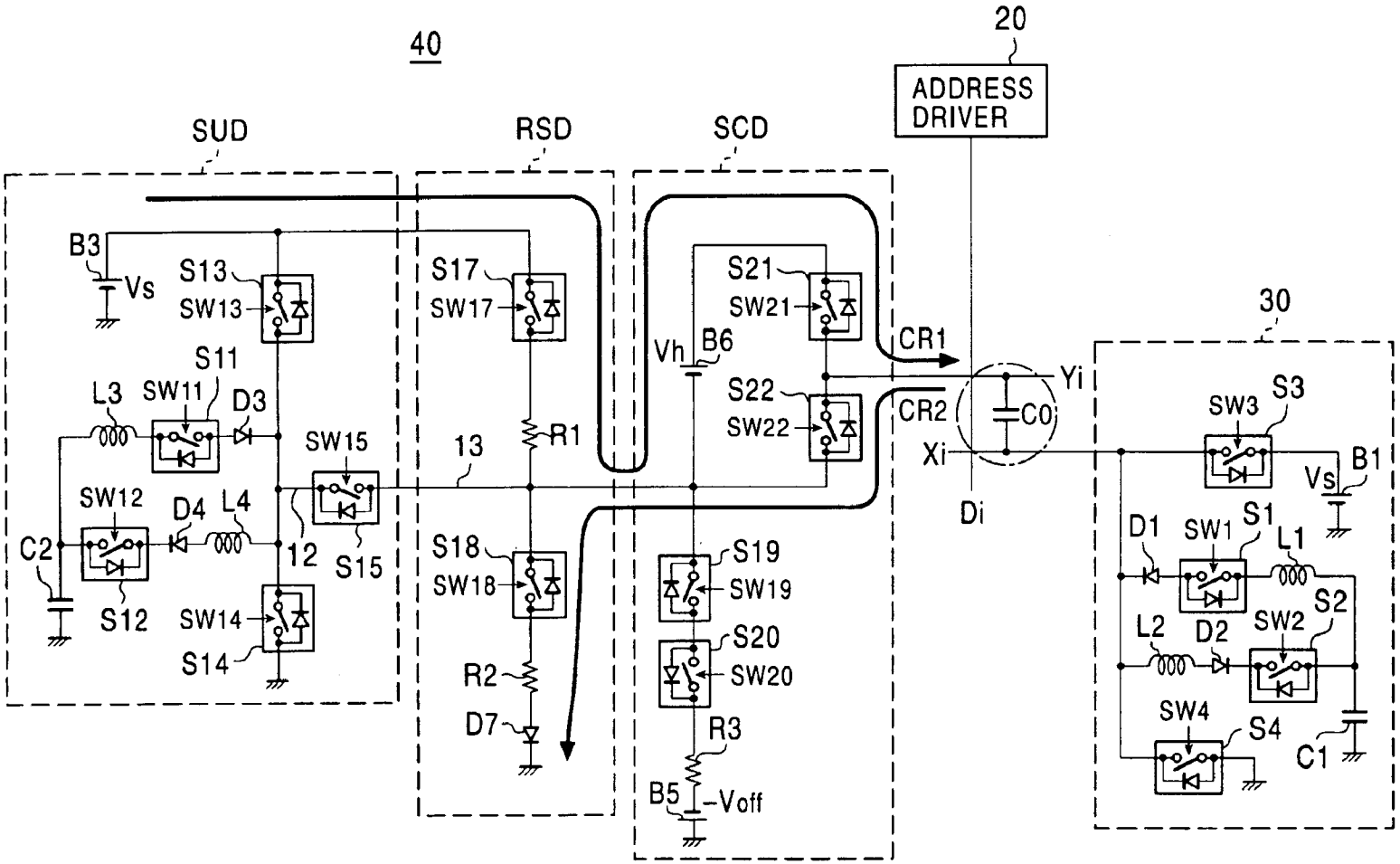
FIG. 6 is a view showing an internal construction of an X row electrode driver 30 and a Y row electrode driver 40 of the plasma display apparatus shown in FIG. 4.

FIG. 6 shows an internal construction of each of the X row electrode driver 30 and the Y row electrode driver 40.

As shown in FIG. 6, one of the ends of a capacitor C1 of the X row electrode driver 30 is grounded to a PDP ground potential as the ground potential of the PDP 10. A switching device S1 remains OFF while a switching signal SW1 of a logic level 0 is supplied from the driving control circuit 50. When the logic level of the switching signal SW1 is 1, on the other hand, the switching device S1 is turned ON and applies a potential occurring at the other end of the capacitor C1 to the row electrode X of the PDP 10 through a coil L1 and a diode D1. A switching device S2 remains OFF while a switching signal SW2 of the logic level 0 is supplied from the driving control circuit 50. When the logic level of the switching signal SW2 is 1, on the other hand, the switching device S2 is turned ON and applies a potential of the row electrode X to the other end of the capacitor C1 through a coil L2 and a diode D2. In this case, the potential of the row electrode X charges the capacitor C1. A switching device S3 remains OFF while a switching signal SW3 of the logic level 0 is supplied from the driving control circuit 50. When the logic level of the switching signal SW3 is 1, on the other hand, the switching device S3 is turned ON and applies a voltage $V_s$ generated by a power source B1 to the row electrode X. Incidentally, the voltage $V_s$ is a pulse voltage of a sustain discharge pulse $IP_x$ to be later described. In other words, the power source B1 is the power source that generates the voltage $V_s$ as the pulse voltage value of the sustain discharge pulse $IP_x$. A switching device S4 remains OFF while a switching signal SW4 of a logic level 0 is supplied from the driving control circuit 50. When the logic level of the switching signal SW4 is 1, on the other hand, the switching device S4 is turned ON and brings the potential of the row electrode X to the PDP ground potential.

The Y row electrode driver 40 includes a sustain driver part SUD, a reset driver part RSD and a scan driver part SCD as shown in FIG. 6.

One of the ends of a capacitor C2 in the sustain driver part SUD is grounded to the PDP ground potential as the ground potential of the PDP 10. A switching device S11 remains OFF while a switching signal SW11 of the logic level 0 is supplied from the driving control circuit 50. When the logic level of the switching signal SW11 is 1, on the other hand, the switching device S11 is turned ON and applies a potential occurring at the other end of the capacitor C2 to a connection line 12 through a coil L3 and a diode D3. A switching device S12 remains OFF while a switching signal SW12 of the logic level 0 is supplied from the driving control circuit 50. When the logic level of the switching signal SW12 is 1, on the other hand, the switching device S12 is turned ON and applies a potential of the connection line 12 to the other end of the capacitor C2 through a coil L4 and a diode D4. In this case, the potential of this connection line 12 charges the capacitor C2. A switching device S13 remains OFF while a switching signal SW13 of the logic level 0 is supplied from the driving control circuit 50. When the logic level of the switching signal SW13 is 1, on the other hand, the switching device S13 is turned ON and applies a voltage $V_s$ generated by a power source B3 to the connection line 12. Incidentally, the voltage $V_s$ is a pulse voltage of a sustain discharge pulse $IP_y$ to be later described. In other words, the power source B1 is the power source that generates the voltage $V_s$ as the pulse voltage value of the sustain discharge pulse $IP_y$. A switching device S14 remains OFF while a switching signal SW14 of the logic level 0 is supplied from the driving control circuit 50. When the logic level of the switching signal SW14 is 1, on the other hand, the switching device S14 is turned ON and brings the potential of the connection line 12 to the PDP ground potential. A switching device S15 remains ON while a switching signal SW15 supplied from the driving control circuit 50 has a logic level 1 and connects the connection line 12 to the later-appearing connection line 13.

A switching device S17 in the reset drive part RSD remains OFF while a switching signal SW17 of the logic level 0 is supplied from the driving control circuit 50. When the logic level of the switching signal SW17 is 1, on the other hand, the switching device S17 is turned ON and connects a positive terminal of the power source B3 to a connection line 13 through a resistor R1. In other words, the switching device S17 applies the voltage $V_s$ generated by the power source B3 to the connection line 13 through the resistor R1 in accordance with the switching signal SW17. A switching device S18 remains OFF while a switching signal SW18 of the logic level 0 is supplied from the driving control circuit 50. When the logic level of the switching signal SW18 is 1, on the other hand, the switching device S18 is turned ON and grounds the connection line 13 through a resistor R2 and a diode D7.

Switching devices S19 and S20 in the scan driver part SCD remain OFF while switching signals SW19 and SW20 of the logic level 0 are supplied from the driving control circuit 50. When the logic level of both of the switching signals SW19 and SW20 is 1, on the other hand, both switching devices S19 and S20 are turned ON and apply a negative voltage ($-V_{off}$) generated by the power source B3 to a connection line 13 through a resistor R3. Incidentally, the voltage ($-V_{off}$) is the one that bears a pulse voltage value of the later-appearing scan pulse SP. In other words, the power source B5 is a power source that generates the voltage ($-V_{off}$) as the pulse voltage value of the scan pulse SP. A switching device S21 remains ON only while a switching signal SW21 supplied from the driving control circuit 50 has the logic level 1 and connects a positive terminal of a power source B6 to the row electrode Y. In other words, the switching device S21 applies the potential of the positive terminal of the power source B6 to the row electrode Y in accordance with the switching signal SW21. A switching device S22 remains ON while a switching signal SW22 supplied from the driving control circuit 50 has the logic level 1 and connects a negative terminal of a power source B6 to the row electrode Y. In other words, the switching device S22 applies the potential of the connection line 13 connected to the negative terminal of the power source B6 to the row electrode Y. The power source B6 is the one that generates a voltage $V_h$ for fixing the voltage on all the row electrodes $Y_1$ to $Y_n$ to a voltage of positive polarity during an address period to be later described. In this case, the voltage $V_h$ forms a part of the pulse voltage in the scan pulse SP. In other words, the power source B6 is the one that generates the voltage $V_h$ forming a part of the pulse voltage in the scanning pulse SP.

Figure 7:
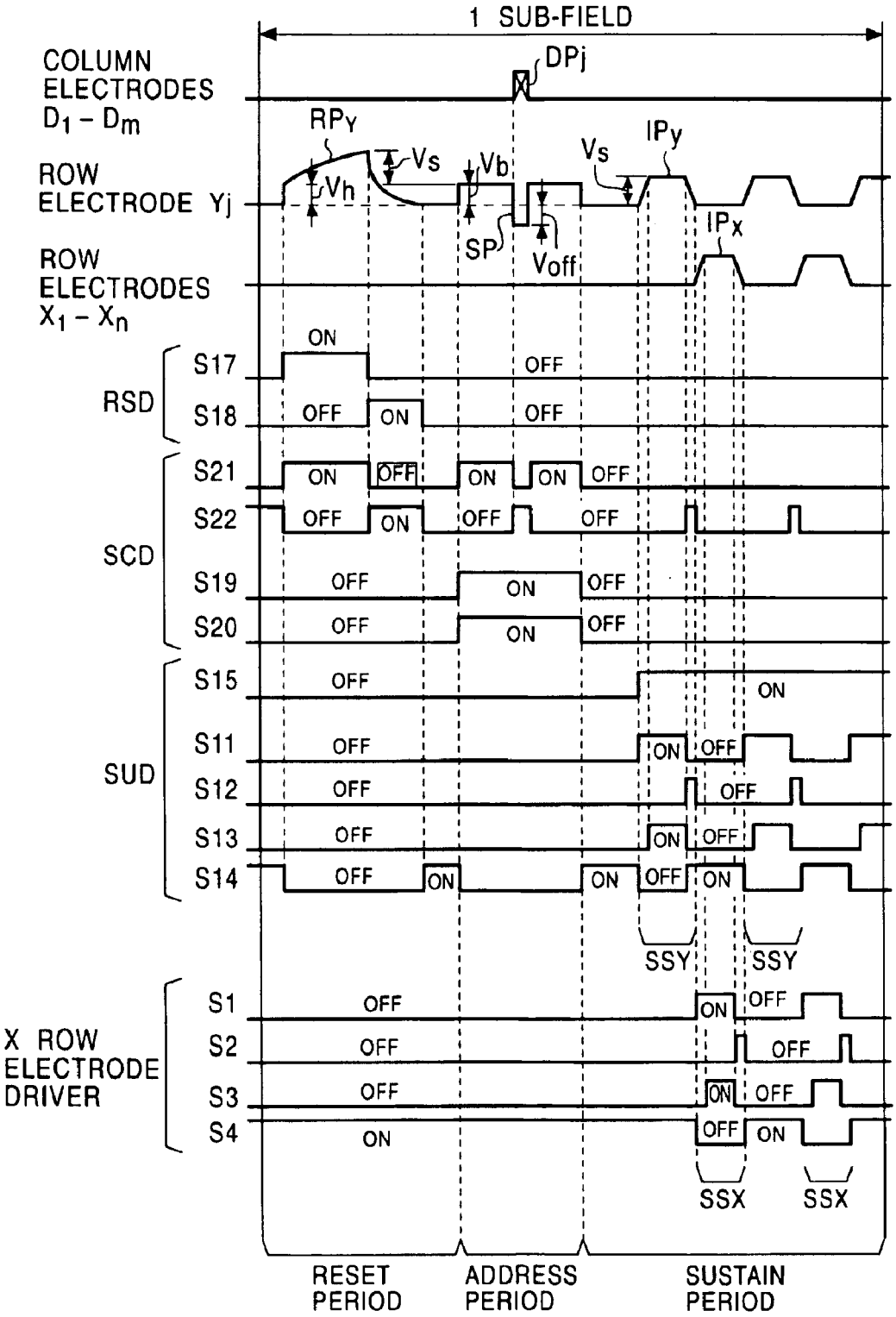
FIG. 7 is a time chart showing operations of the X row electrode driver 30 and the Y row electrode driver 40.

Next, the operation of the construction described above will be explained with reference to the timing chart of FIG. 7. Incidentally, FIG. 7 shows in extraction the operation inside the leading sub-field SF1 shown in FIG. 5. As shown in FIG. 7, the sub-field SF1 has a reset period, an address period and a sustain period.

First of all, in the reset period, the driving control circuit 50 switches the switching devices S17 and S21 in the reset driver part RSD from the OFF state to the ON state. Consequently, a current flows into the discharge cells through a current path (represented by CR1 in FIG. 6) including the power source B3, the switching device S17, the resistor R1, the power source B6, the switching device S21 and the row electrode Y. In this case, the voltage on the row electrode Y gradually rises as shown in FIG. 7 in accordance with a time constant of a load capacitance C0 and the resistor R1 of the PDP 10. When the voltage on the row electrode Y reaches a voltage ($V_s$+$V_h$) created by the series connection of the power source B3 and the power source B6, the driving control circuit 50 switches the switching devices S17 and S21 to the OFF state and the switching devices S18 and S22 to the ON state. In consequence, a current path (represented by CR2 in FIG. 6) including the switching devices S22 and S18, the resistor R2 and the diode D7 is formed, and the potential on the row electrode Y gradually lowers as shown in FIG. 7. Due to the operation described above, a reset pulse $RP_y$ having pulse voltage ($V_s$+$V_h$) shown in FIG. 7 and exhibiting a gentle rise and fall shift is created and is simultaneously applied to all the row electrodes $Y_1$ to $Y_n$ of the PDP 10. In this case, first reset discharge (write discharge) is generated inside all the discharge cells of the PDP 10 at the rise of the reset pulse $RP_y$. After this discharge is completed, a predetermined amount of wall charge is uniformly generated in the dielectric layers of all the discharge cells. Second reset discharge (erase discharge) is generated inside all the discharge cells at the fall of the reset pulse $RP_y$ and the wall charge described above disappears from inside all the discharge cells. In other words, the wall charge formation state inside all the discharge cells is initialized in accordance with first and second reset discharges generated in response to the application of the reset pulse $RP_y$.

Next, in the address period, the driving control circuit 50 switches the switching devices S19 to S21 in the scan driver part SCD from the ON state to the OFF state. Consequently, the voltage on the row electrode Y is kept at the voltage $V_h$ of the positive polarity generated by the power source B3 as shown in FIG. 7. The driving control circuit 50 serially switches the switching device S21 corresponding to each of the first to nth display lines to the OFF state for a predetermined period and serially switches the switching device S22 corresponding to each of the first to nth display lines to the ON state for a predetermined period. Then, while the switching device S21 is OFF and the switching device S22 is ON, the potential of each of the row electrodes $Y_1$ to $Y_n$ serially shifts from the positive voltage $V_h$ to the negative voltage $-V_{off}$, thereby creating the scanning pulse SP. In the mean time, the address driver 2 applies the pixel data pulse DP corresponding to the pixel data for each pixel based on the image signal to the column electrode $D_1$ to $D_m$ for one display line (m). Consequently, write discharge selectively occurs inside the discharge cell to which the high-voltage pixel data pulse DP is applied simultaneously with the scanning pulse SP described above, and wall discharge is generated after this discharge is completed. On the other hand, write discharge does not occur inside the discharge cells to which the scan pulse SP is applied but the high-voltage pixel data pulse is not, and wall discharge is not generated, either. In this address period, the discharge cell in which the wall discharge is generated is set to the cell ON state and the discharge cells in which the wall discharge disappears are set to the OFF cell state.

In the sustain period, the driving control circuit 50 first switches the switching device S14 of the sustain driver part SUD from the OFF state to the ON state and after the passage of a predetermined period, switches the switching device S15 of the sustain driver part SUD from the OFF state to the ON state. The driving control circuit 50 executes repeatedly switching setting SSY for each of the switching devices S11 to S14 of the sustain driver part SUD as shown in FIG. 7. Further, the driving control circuit-50 executes repeatedly switching setting SSX for each of the switching devices S1 to S4 of the X row electrode driver 30 as shown in FIG. 7.

In other words, in switching setting SSX, only S1 of the switching devices S1 to S4 is first turned ON and the current resulting from the charge stored in the capacitor C1 flows into the discharge cells through the coil L1, the diode D1 and the row electrodes X. In consequence, the voltage on the row electrode X gradually rises as shown in FIG. 7. Next, the switching device S3 is turned ON with S1 and the voltage $V_s$ by the power source B1 is as such applied to the row electrode X. The voltage on the row electrode X is fixed at the voltage $V_s$. Next, only S2 of the switching devices S1 to S4 is turned ON and the current resulting from the charge stored in the load capacitance Co between the row electrodes X and Y flows into the capacitor C1 through the row electrode X, the coil L2 and the diode D2. In consequence, the voltage on the row electrode X gradually drops as shown in FIG. 7. As switching setting SSX described above is interruptedly executed, the sustain discharge pulse $IP_x$ with the voltage Vs as the pulse voltage is created as shown in FIG. 7 and is repeatedly applied to the row electrode X.

In switching setting SSY, on the other hand, only S11 of the switching devices S11 to S14 and S17 to S22 is first turned ON and the current resulting from the charge stored in the capacitor C2 flows into the discharge cells through the coil L3, the diode D3, the switching device S15, the switching device S22 and the row electrode Y. In consequence, the voltage of the row electrode Y gradually rises as shown in FIG. 7. Next, the switching device S13 is turned ON with S11 and the voltage $V_s$ by the power source B3 is applied to the row electrode Y through the switching devices S15 and S22. The voltage on the row electrode Y is fixed at the voltage $V_s$ as shown in FIG. 7. Next, only S12 of the switching devices S11 to S14 and only S22 of the switching devices S17 to S22 are turned ON and the current resulting from the charge stored in the load capacitance Co between the row electrodes X and Y flows into the capacitor C1 through the row electrode Y, the switching devices S22 and S15, the coil L4 and the diode D4. In consequence, the voltage on the row electrode Y gradually drops as shown in FIG. 7. As switching setting SSY described above is interruptedly executed, the sustain discharge pulse $IP_y$ with the voltage Vs as the pulse voltage is created as shown in FIG. 7 and is repeatedly applied to the row electrode Y.

In the sustain period, only the discharge cell in which the wall charge exists, that is, only the discharge cell set to the ON cell state, causes discharge (sustain discharge) whenever the sustain discharge pulses $IP_x$ and $IP_y$ are applied, and repeats emission of light with the discharge.

As described above, in the Y row electrode driver 40 shown in FIG. 6, the switching devices 17 and 21 are turned ON when the reset pulse $RP_y$ is generated. Consequently, the power source B3 for generating the sustain discharge pulse $IP_y$ and the power source B6 for generating the scan pulse SP are connected in series and the voltage $(V_s+V_h)$ as the sum of both voltages is generated as the pulse voltage of the reset pulse RP. In other words, the reset pulse having a pulse voltage of a relatively high voltage can be generated without disposing a dedicated power source for generating the reset pulse. In this case, since the dedicated power source for generating the reset pulse is not necessary, a reverse current to the power source B3 for generating the sustain discharge pulse $IP_y$ does not occur. In other words, because a reverse current prevention circuit and a dedicated power source for generating the reset pulse are not necessary, a circuit scale can be reduced.

The wave form of the reset pulse $PR_y$ is not limited to that shown in FIG. 7. It is also possible to apply the reset pulse simultaneously to the row electrodes X and the row electrodes Y, so that the first reset discharge described above is generated.

Figure 8:
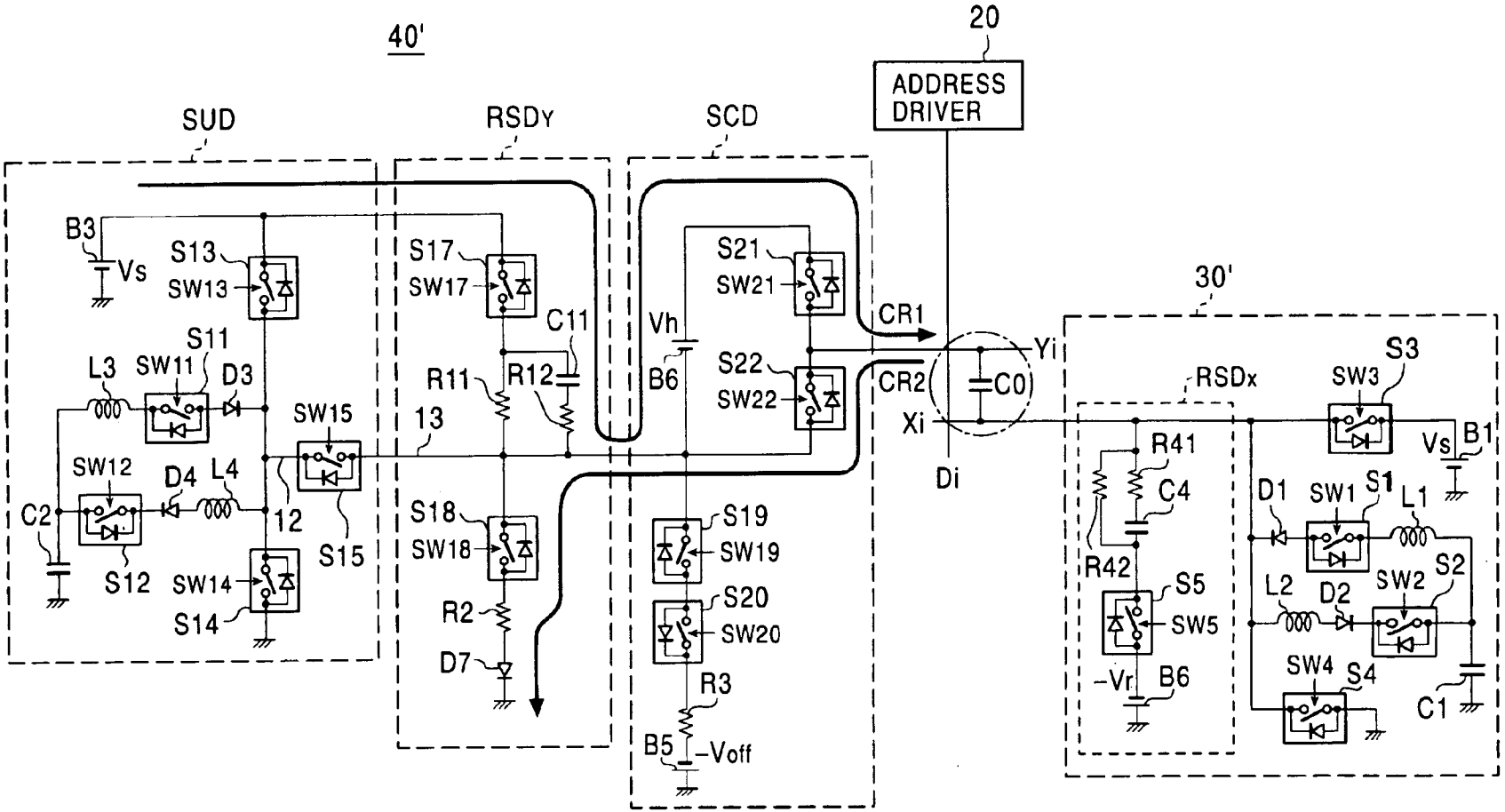
FIG. 8 is a view showing an internal construction of an X row electrode driver 30' and a Y row electrode driver 40' according to a second embodiment.

FIG. 8 shows the internal structure of each of an X-row electrode driver 30' and a Y-row electrode driver 40' in another embodiment of the present invention which is constructed in view of the points described above.

The driver shown in FIG. 8 features that a reset drive part $RSD_y$ is adopted instead of the reset driver RSD, and a reset-driver part $RSD_x$ is provided in the X-row electrode driver 30'. The remaining circuit structure is the same as those shown in FIG. 6.

One of the electric terminals of each of resistors R11 and R12 provided in the reset driver $RSD_y$ is connected to the connection line 13. The other electric terminal of the resistor 12 is connected to one of the electric terminals of the capacitor C11, and the other electric terminal of the capacitor C11 is connected to the other electric terminal of the resistor R11 described above. In other words, a series circuit made up of the resistor R12 and the capacitor C11 is connected in parallel with the resistor R11, across its two electric terminals. The resistance of the resistor R11 is higher than that of the resistor R12. The switching element S17 remains OFF when the switching signal SW17 has a logical 0 level, and is turned ON to apply the voltage $V_s$ at the positive terminal of the above-described power source B3 to the connection line 13 via the circuit made up of the resistors R11 and R12 when the signal SW17 has a logical "1" level. The switching element S18 remains OFF when the switching signal SW18 has the logical 0 level, and is turned ON to connect the connection line 13 to the ground via the resistor R2 and the diode D7 when the the switching signal SW18 has the logical 1 level.

One of the electric terminals of each of the resistors R41 and R42 in the reset driver part $RSD_x$ is respectively connected to the row electrode X. The other electric terminal of the resistor R41 is connected to one of the electric terminals of the capacitor C4, and the other electric terminal of the capacitor C4 is connected to the other electric terminal of the above-described resistor R42. In other words, a series circuit made up of the resistor R41 and the capacitor C4 is connected in parallel with the resistor R42 across its two electric terminals. The resistor R42 has a resistance higher than that of the resistor R41. The switching element S5 remains OFF when the switching signal SW5 has the logical 0 level, and is turned ON to apply the voltage (−Vr) at the negative terminal of the power source B7 to the row electrodes X via the circuit made up of the above-described capacitor C4, resistors R41 and 42 when the the switching signal SW5 has the logical 1 level.

The operation of the circuit having the structure described above will be explained with reference to the timing chart shown in FIG. 9.

Figure 9:
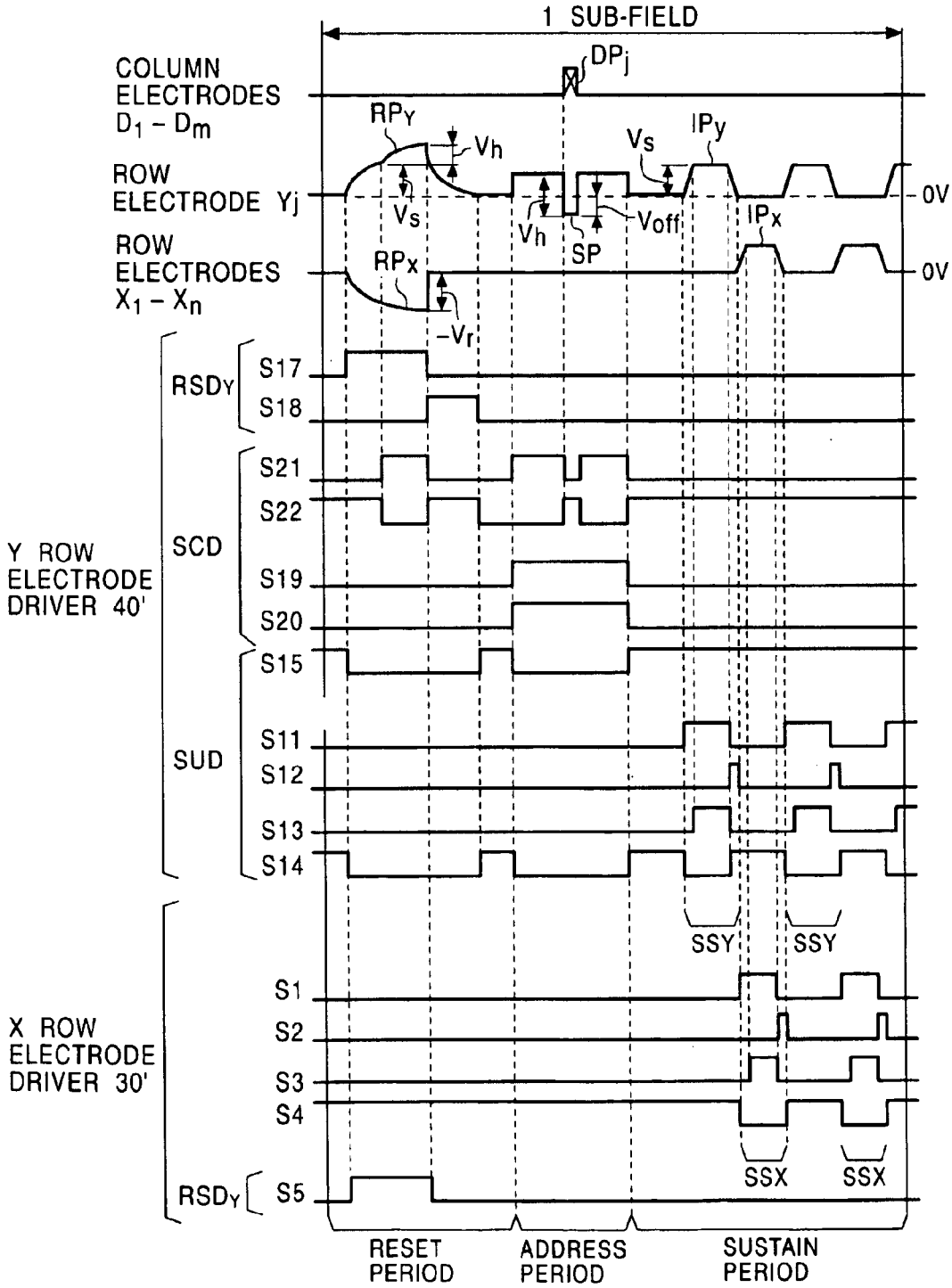
FIG. 9 is a time chart showing operations of the X row electrode driver 30' and the Y row electrode driver 40' shown in FIG. 8.

FIG. 9 is an extract diagram that shows the operations in the head subfield shown in FIG. 5, of which the operations in the periods excluding the reset period (address period and the sustain period) are the same as those shown in FIG. 7.

In the reset period shown in FIG. 9, the drive control circuit 50 sets the switching element S17 in the reset driver part $RSD_Y$ in the Y row electrode driver 40 to the ON state, and set the switching element S22 in the scan driver part SCD to the ON state. With this setting, the voltage Vs of the power source B3 in the sustain driver part SUD is applied to the row electrodes Y via the capacitor C11, resistor R12, connection line 13, and the switching element S22. Consequently, the voltage at the row electrodes Y gradually goes up from 0 volt as shown in FIG. 9. In this process, when the voltage at the row electrodes Y reaches the voltage Vs upon the lapse of a predetermined period after the switching element S17 has been set to the ON state, the drive control circuit 50 sets the switching device S22 to the OFF state, and the switching device S21 to the ON state respectively. As a result, a current route CR1 through the power source B3, switching element S17, capacitor C11, resistor R12, power source B6, switching element S21, and row electrodes Y is formed, so that a voltage formed by adding the voltage Vh of the power source B6 on the above-described voltage Vs is applied to the row electrodes Y. In this state, the voltage at the row electrodes goes up at a rate slower than the rate before the voltage of the row electrodes reaches the voltage Vs, as shown in FIG. 9. When the voltage at the row electrodes Y reaches a voltage (Vs+Vh), the drive control circuit 50 turns OFF the switching elements S17 and S21 and turns ON the switching elements S18 and S22, respectively. As a result, a current route CR2 which includes the switching elements S22, S18, resistor R2, and diode D7 is formed, so that the voltage at the row electrodes Y gradually decreases as shown in FIG. 9.

By the sequential operations described above, a reset pulse $RP_Y$ having a waveform illustrated in FIG. 9 is generated. Specifically, the voltage of the reset pulse $PR_Y$ gradually goes up from 0 volt, the rate of the rise of the voltage becomes slower after the lapse of a predetermined period, and finally the voltage reaches the maximum voltage (Vs+Vh). The reset pulse having this waveform is applied to all of the row electrodes Y1 through Yn.

Furthermore, in the reset period shown in FIG. 9, during the period in which the switching element S17 is set to the ON state, the drive control circuit 50 sets the switching element S5 in the reset driver section $RSD_X$ in the X row electrode driver 30 to the ON state. With this setting, the voltage (−Vr) at the negative terminal of the power source B7 is applied to the row electrode X through the circuit made up of the switching element S5, capacitor C4, resistors R41 and R42. In this process, the voltage at the row electrodes X gradually lowers from 0 volt as illustrated in FIG. 9. When the voltage at the row electrodes X reaches the above-described voltage (−Vr), the drive control circuit 50 turns OFF the switching element S5.

By the sequential operations described above, the reset pulse RPx having the waveform shown in FIG. 9 is generated. Specifically, the voltage of the reset pulse RPx gradually lowers from 0 volt and reaches a minimum voltage (−Vr). The reset pulse RPx is applied to all of the row electrodes $X_1$ to $X_n$.

By the simultaneous application of the reset pulse $RP_Y$ of the positive polarity and the reset pulse $RP_X$ of the negative polarity, the reset discharge is generated in all of the discharge cells.

In this process, owing to the application of the reset pulse $RP_Y$ having the waveform shown in FIG. 9, a weak reset discharge having a low light emission intensity is repetitively generated even if the pulse voltage level is at a relatively low voltage level. By the repetitive generation of the reset discharge, it is possible to accumulate a sufficient amount of the wall charge in each of the discharge cells. Consequently, it is possible to use a driver of a low voltage resistance having a relatively low price as the driver for generating the reset pulse.

In the embodiment shown in FIG. 9, the waveform of the falling edge of the reset pulse $RP_Y$ is moderate. It is, however, possible to employ a reset pulse having a steep falling edge. For instance, instead of setting the switching element S18 to the ON state, it is possible to set both of the switching elements S14 and S15 to the ON state. In this case, the waveform of the falling edge of the reset pulse $RP_Y$ becomes such a waveform that it steeply varies to 0 volt from the maximum voltage (Vs+Vh).

Next, the third embodiment of the invention will be explained with reference to the drawings.

Figure 10:
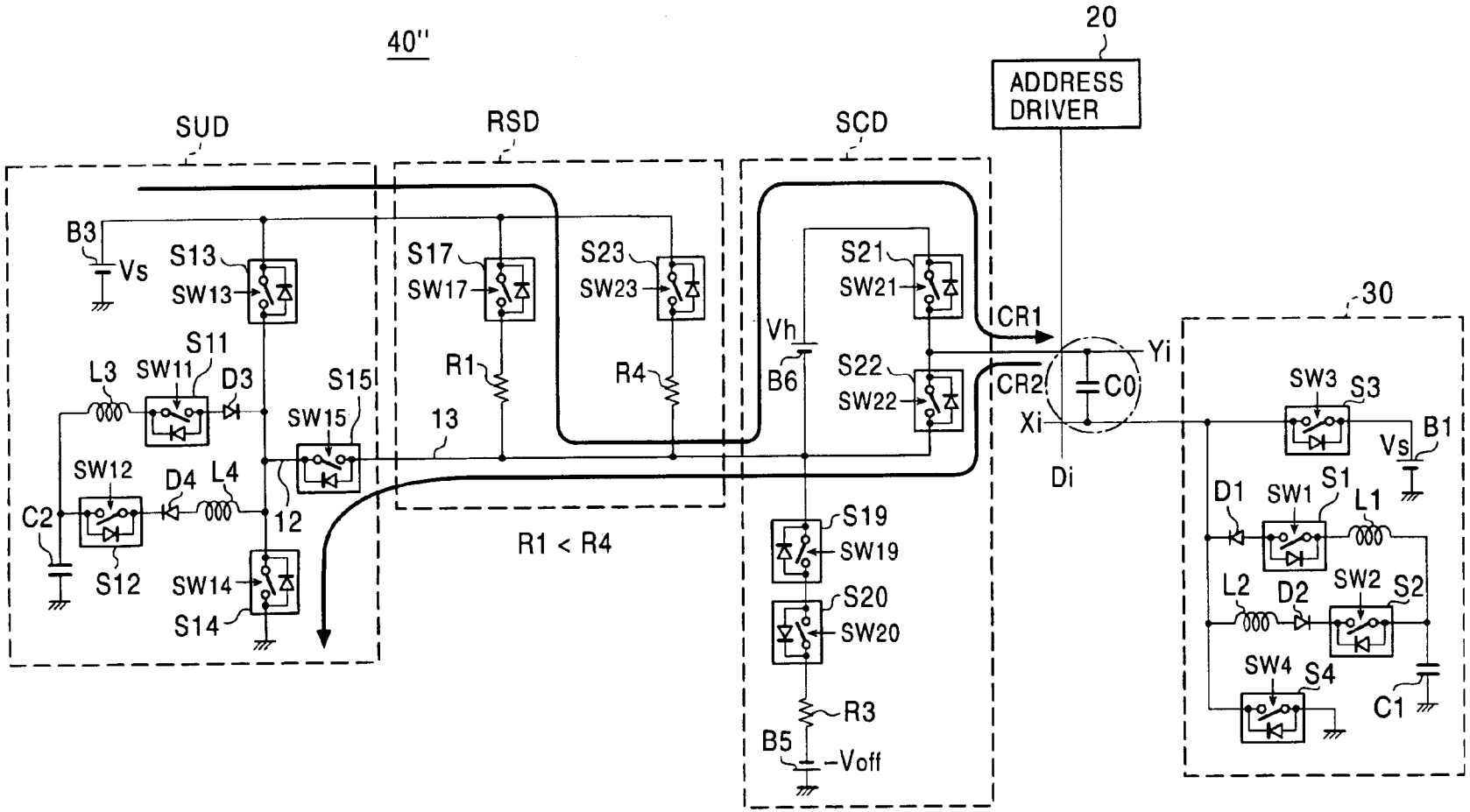
FIG. 10 is a view showing an internal construction of the X row electrode driver 30 and a Y row electrode driver 40" according to a third embodiment.

FIG. 10 shows an internal construction of each of an X row electrode driver 30 and a Y row electrode driver 40" in the second embodiment. This construction is the same as the construction shown in FIG. 6 with the exception of the reset driver part RSD of the Y row electrode driver 40", and the explanation will not be repeated.

A switching device S23 is disposed in the reset driver part RSD in addition to the switching device S17. The switching device 23 remains OFF while the driving control circuit 50 supplies thereto a switching signal SW23 of the logic level 0. When the switching signal SW23 has the logic level 1, on the other hand, the switching device S23 is turned ON and connects the positive terminal of the power source B3 to the connection line 13 through the resistor R4. In other words, the switching device S23 applies the voltage Vs generated by the power source B3 in accordance with the switching signal SW23 to the connection line 13 through the resistor R4. Incidentally, the resistor R4 has a resistance value higher than that of the resistor R1.

Next, the operation in the construction described above will be explained with reference to a timing chart of FIG. 11. The sub-field SF1 has a reset period, an address period and a sustain period in the same way as in FIG. 7. Only the reset period is different from FIG. 7. In the reset period, the driving control circuit 50 turns OFF the switching device S14 of the sustain driver part SUD and turns ON the switching device S15. In this reset period, the driving control circuit 50 executes a first waveform generation step RS1 for generating a leading edge portion of a reset pulse and a second waveform generation step RS2 for generating a main body portion of the reset pulse. In the first waveform generation step RS1, the switching device S23 of the reset driver part RSD is set to the OFF state and the switching device S17, to the ON state. In the second waveform generation step RS2, the switching device S23 of the reset driver part RSD is set to the ON state and the switching device S17, to the OFF state. Further, in the first and second waveform generation steps RS1 and RS2, the switching device S21 of the scan driver part SCD is set to the ON state and the switching device S22, to the OFF state. Therefore, while the first and second waveform generation steps RS1 and RS2 are executed, the voltage $V_h$ of the power source B6 of the scan driver part SCD is applied to the row electrode Y and the current from the power source B3 of the sustain driver part SUD flows into the discharge cells through the current path represented by CR1 in FIG. 10.

In this case, in the first waveform generation step RS1, the current from the power source B3 flows into the discharge cells through the switching device S17 and the resistor R1. Therefore, the voltage on the row electrode Y set to the voltage $V_h$ gradually increases with inclination shown in FIG. 11 in accordance with the time constant (C0, R1) of the PDP 10 determined by the load capacitance C0 and the resistor R1. When the voltage of the row electrode Y exceeds the predetermined voltage Vc, the driving control circuit 50 shifts to the execution of the second waveform generation step RS2. Incidentally, the predetermined voltage Vc is a voltage slightly lower than the discharge start voltage of the discharge cells in the PDP 10. In the second waveform generation step RS2, the current from the power source B3 flows into the discharge cells through a current path of the switching device S23 and the resistor R4 instead of the switching device S17 and the resistor R1 described above. Consequently, the voltage on the row electrode Y gradually increases with inclination shown in FIG. 11 in accordance with the time constant (C0, R2) of the PDP 10 determined by the load capacitance C0 and the resistor R2. Since the resistor R4 is higher than the resistor R1 in this case, the rise of the voltage in the first waveform generation step RS1 is sharper than the rise of the voltage in the second waveform generation circuit as shown in FIG. 11. When the voltage on the row electrode Y reaches the voltage ($V_s$+$V_h$) generated by the series connection of the power source B3 and the power source B6, the driving control circuit 50 switches both the switching devices S23 and S21 to the OFF state and the switching device S22 to the ON state. Consequently, a current path of the switching devices S22, S15 and S14 (represented by CR2 in FIG. 10) is formed, and the voltage on the row electrode Y immediately changes to 0 volt. When the first and second waveform generation steps RS1 and RS2 are executed, a reset pulse $RP_Y$ the voltage level of which rises relatively sharply at the leading edge-and relatively gently thereafter and which reaches the highest pulse voltage value ($V_s$+$V_h$) is generated, and this voltage is applied to all the row electrodes Y. In this process, when the voltage of the reset pulse $RP_y$ exceeds the predetermined voltage Vc shown in FIG. 11, a first reset discharge (write discharge) is generated inside each discharge cell. Due to this first reset discharge, charge particles are generated inside the discharge space of each discharge cell and a predetermined amount of the wall charge is generated in the dielectric layer. Second reset discharge (erase discharge) is generated in all the discharge cells at the fall of the reset pulse $RP_y$, and the wall charge disappears from inside all the discharge cells. In other words, all the discharge cells are initialized to the OFF mode due to the first and second reset discharges induced in accordance with the application of the reset pulse $RP_y$.

Figure 11:
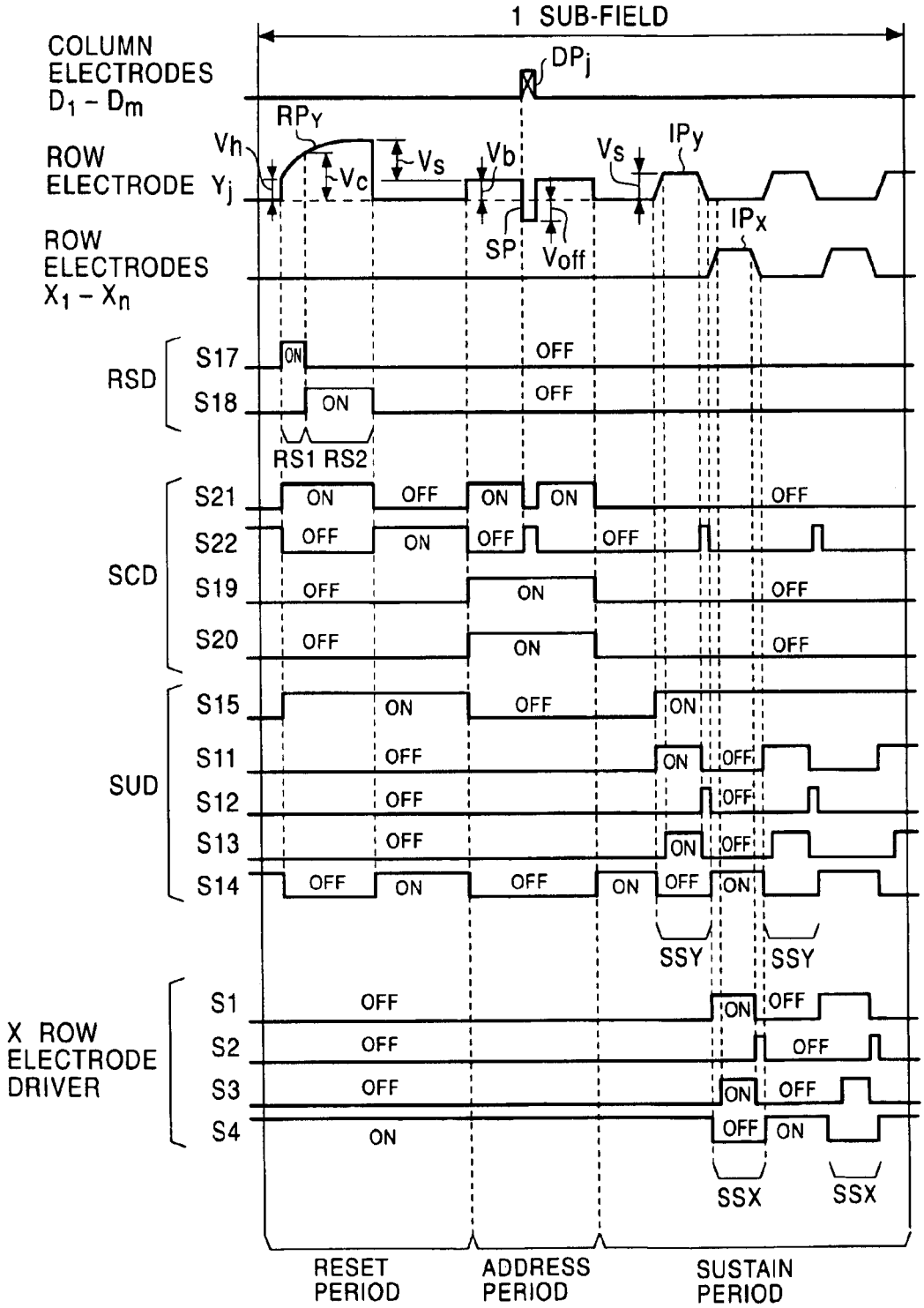
FIG. 11 is a time chart showing operations of the X row electrode driver 30 and the Y row electrode driver 40" shown in FIG. 10.

Taking variance of the discharge start voltage of each discharge cell formed in the PDP 10 into account, this embodiment generates the reset discharge by use of the reset pulse $RP_y$ the voltage level of which changes gradually as shown in FIG. 11 and suppresses light emission brightness resulting from the reset discharge. In other words, when the reset pulse $RP_y$ shown in FIG. 11 is applied, the voltage level on the row electrode Y gradually rises. In the execution period of the second waveform generation step RS2, the reset discharge is generated gradually from the discharge cell having a low discharge start voltage to the discharge cell having a high discharge start voltage. Therefore, in comparison with the case where all the discharge cells execute all at once the reset discharge, light emission brightness resulting from the reset discharge becomes lower. In this invention, the voltage level at the front edge of the reset pulse $RP_y$, that is, the portion at which the voltage level exceeds the predetermined voltage Vc in FIG. 7 (first waveform generation step RS1) shifts at this time more sharply than in the subsequent portion (second waveform generation portion RS2). In other words, the level shift at the front edge of the reset pulse $RP_y$ is sharp, the time till its voltage level reaches a voltage (predetermined voltage Vc) slightly lower than the lowest discharge start voltage that can be used as the discharge start voltage of each discharge cell can be shortened.

Accordingly, the execution period of the second waveform generation step RS2 can be elongated without expanding the pulse width of the reset pulse and the timing of the reset discharge induced in each discharge cell can be dispersed. Because the number of the reset discharge induced at the same timing can be reduced and light emission brightness resulting from the reset discharge can be lowered, the contrast of the screen can be enhanced.

This application is based on Japanese Patent Applications Nos. 2002-310140, 2003-77872 and 2003-197005 which are herein incorporated by reference.

What is claimed is:

1. A driving apparatus for driving a display panel having a plurality of row electrodes, a plurality of column electrodes so arranged as to intersect said row electrodes and a capacitive light emission device formed at each intersection of said row electrode and said column electrode, comprising:

a scan driver having a first power source for generating a first voltage, generating a scan pulse for bringing said capacitive light emission device to either one of an ON state and an OFF state based on the first voltage, and applying the scan pulse to said row electrode, a sustain driver having a second power source for generating a second voltage, generating a sustain pulse for allowing said capacitive light emission device set to said ON state to emit light based on said second voltage, and applying said scan pulse to said row electrode; and a reset driver generating a reset pulse for initializing the state of said capacitive light emission device based on the sum of said first voltage generated by said first power source and said second voltage generated by said second power source, and applying said reset pulse to said row electrode.

2. A driving apparatus for a display panel according to claim 1, wherein said reset driver includes:

a first switching circuit for connecting a positive terminal of said second power source and a negative terminal of said first power source through a first resistor; and a second switching circuit for grounding the negative terminal of said first power source through a second resistor.

3. A driving apparatus for a display panel according to claim 1, wherein said scan driver includes:

a third switching circuit for connecting the positive terminal of said first power source and said row electrode; and a fourth switching circuit for connecting the negative terminal of said first power source and said row electrode.

4. A driving apparatus for a display panel according to claim 1, wherein said reset driver includes:

a first switching circuit for connecting a positive terminal of said second power source and a negative terminal of said first power source through a first resistor; and a second switching circuit for grounding the negative terminal of said first power source through a second resistor, and said scan driver includes:

a third switching circuit for connecting the positive terminal of said first power source and said row electrode; and a fourth switching circuit for connecting the negative terminal of said first power source and said row electrode.

5. A driving apparatus for a display panel according to claim 4, further comprising a series circuit of a capacitor and a third resistor which is connected in parallel with said first resistor, wherein a resistance value of said first resistor is higher than a resistance value of said third resistor.

6. A driving apparatus for a display panel according to claim 4, wherein a reset pulse having a waveform in which a voltage rises gradulally is generated by setting said third switching circuit to an ON state and setting said fourth switching circuit to an OFF state when a predetermined period has elapsed after setting both of said first switching circuit and said fourth switching circuit to the ON state, and said reset pulse is applied to said row electrodes.

7. A driving apparatus for a display panel according to claim 5, wherein a reset pulse having a waveform in which a voltage rises gradulally is generated by setting said third switching circuit to an ON state and setting said fourth switching circuit to an OFF state when a predetermined period has elapsed after setting both of said first switching circuit and said fourth switching circuit to the ON state, and said reset pulse is applied to said row electrodes.

8. A driving apparatus for driving a display panel having a plurality of row electrodes, a plurality of column electrodes so arranged as to intersect said row electrodes and a capacitive light emission device formed at each intersection of said row electrode and said column electrode, comprising:

a scan driver having a first power source for generating a first voltage, generating a scan pulse for bringing said capacitive light emission device to either one of an ON state and an OFF state based on said first voltage, and applying said scan pulse to said row electrode;

a sustain driver having a second power source for generating a second voltage, generating a sustain discharge pulse for allowing said capacitive light emission device set to said ON state to emit light based on said second voltage, and applying said scan pulse to said row electrode; and a reset driver generating a reset pulse for initializing the state of said capacitive light emission device based on the sum of said first voltage generated by said first power source and said second voltage generated by said second power source, and applying said reset pulse to said row electrode;

wherein said reset driver generates a pulse signal having a waveform exhibiting a sharp level shift at a front edge thereof and a gentle level shift at a portion succeeding said front edge.

9. A driving apparatus for a display panel according to claim 8, wherein said reset driver individually generates a sharp change voltage exhibiting a sharp level shift and a gentle change voltage exhibiting a gentle level shift and adds them together to generate said reset pulse.

10. A driving apparatus for a display panel according to claim 8, wherein said reset driver includes:

a first switching circuit for generating said sharp change voltage by connecting a positive terminal of said second power source and a negative terminal of said first power source through a first resistor; and a second switching circuit for generating said gentle change voltage by connecting the positive terminal of said second power source and the negative terminal of said first power source through a second resistor having a higher resistance than said first resistor.

11. A driving apparatus for a display panel according to claim 9, wherein said reset driver includes:

a first switching circuit for generating said sharp change voltage by connecting a positive terminal of said second power source and a negative terminal of said first power source through a first resistor; and a second switching circuit for generating said gentle change voltage by connecting the positive terminal of said second power source and the negative terminal of said first power source through a second resistor having a higher resistance than said first resistor.

12. A driving apparatus for a display panel according to claim 10, wherein said reset driver further includes:

control means for setting said first switching circuit to the ON state and said second switching circuit to the OFF state and then switches said first switching circuit to the OFF state and said second switching circuit to the ON state.

13. A driving apparatus for a display panel according to claim 11, wherein said reset driver further includes:

control means for setting said first switching circuit to the ON state and said second switching circuit to the OFF state and then switches said first switching circuit to the OFF state and said second switching circuit to the ON state.

* * * * *

UNITED STATES PATENT AND TRADEMARK OFFICE

CERTIFICATE OF CORRECTION

PATENT NO. : 6,876,341 B2
DATED : April 5, 2005
INVENTOR(S) : Shigeo Ide et al.

It is certified that error appears in the above-identified patent and that said Letters Patent is hereby corrected as shown below:

Column 15,
Line 54, "a sustain" should start a new paragraph;
Line 59, delete "scan" and insert -- sustain --.

Column 17,
Line 1, delete "scan" and insert -- sustain --.

Signed and Sealed this

Second Day of August, 2005

JON W. DUDAS
*Director of the United States Patent and Trademark Office*